United States Patent [19]

Omholt

[11] 4,233,793

[45] Nov. 18, 1980

[54] RESILIENTLY CUSHIONED ADHESIVE-APPLIED WOOD FLOORING SYSTEM AND METHOD OF MAKING THE SAME

[76] Inventor: Ray E. Omholt, 590 Grove Rd., Thorofare, N.J. 08086

[21] Appl. No.: 593,607

[22] Filed: Jul. 7, 1975

Related U.S. Application Data

[63] Continuation-in-part of Ser. No. 339,496, Mar. 8, 1973, Pat. No. 3,893,275.

[51] Int. Cl.[2] ..... E04F 13/00

[52] U.S. Cl. ..... 52/390; 52/747

[58] Field of Search ..... 52/309, 384, 389, 480, 52/390, 346, 415, 508, 746, 506, 403, 393, 385–388, 391, 392; 404/31, 32

[56] References Cited

U.S. PATENT DOCUMENTS

| | | | |
|---|---|---|---|
| 1,852,696 | 4/1932 | Chaffee | 52/389 |
| 1,925,070 | 8/1933 | Livezey | 52/747 |
| 2,026,511 | 12/1935 | Storm | 52/506 |
| 2,531,128 | 11/1950 | Hobbs | 52/746 |
| 3,085,482 | 4/1963 | Yakubik | 52/390 |
| 3,365,850 | 1/1968 | Marino | 52/573 |
| 3,432,451 | 3/1969 | Kales | 260/23 R |
| 3,461,844 | 8/1969 | Harrison | 404/32 |

OTHER PUBLICATIONS

The Condensed Chemical Dictionary by Reinhold Publishing Corp. 1956, p. 195.

*Primary Examiner*—John E. Murtagh

*Attorney, Agent, or Firm*—Seidel, Gonda, Goldhammer & Panitce

[57] ABSTRACT

A resiliently cushioned adhesive applied restricted growth bridging wood flooring system is provided. The wood floor members are held in place by spaced ridges of elastomeric cushioning adhesive material between the wood flooring members and the supporting base. The elastomeric cushioning adhesive material has sufficient gripping and tensile strength to overcome normal horizontal and vertical expansive buckling forces which can be generated by an increased moisture content within the wood flooring members during periods of normal atmospheric moisture changes. The elastomeric cushioning adhesive material also provides substantial resilient cushioned support under the wood flooring members, absorbs impact sounds between floors of multistory buildings, and provides a substantially level floor even though the supporting base may be non-planar.

9 Claims, 3 Drawing Figures

FIG. 1
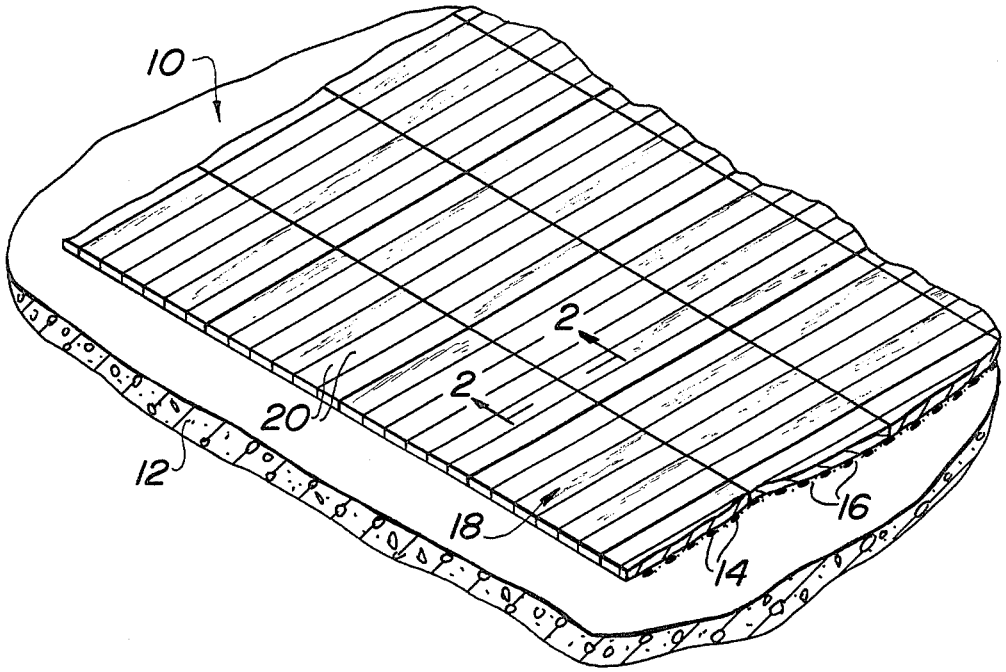
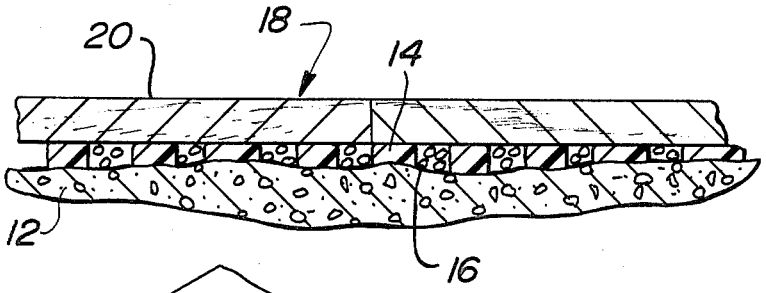
FIG. 2
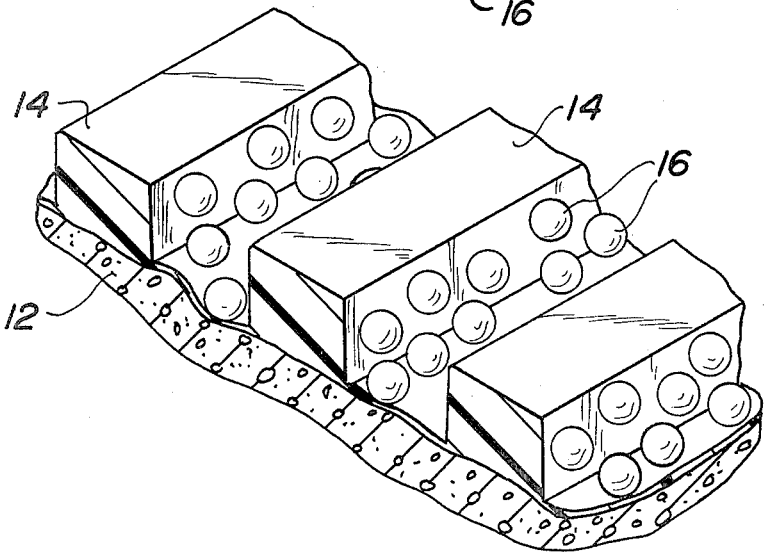
FIG. 3

RESILIENTLY CUSHIONED ADHESIVE-APPLIED WOOD FLOORING SYSTEM AND METHOD OF MAKING THE SAME

RELATED APPLICATION

This application is a continuation-in-part of my copending application Ser. No. 339,496 filed Mar. 8, 1973, now U.S. Pat. No. 3,893,275, entitled "Rebound Wall and Method".

This invention pertains to the field of wood flooring systems of the type wherein a supporting base is covered with a resiliently cushioned adhesive-applied wooden floor. Such systems are in common use in apartment buildings, office buildings, gymnasiums and the like.

Such wood floors require a flat upper surface with essentially no openings between boards to achieve a desired appearance and to minimize maintenance. Such floors must also withstand normal use without buckling, warping, or forming other surface irregularities. In addition, the floor should ideally be provided with a uniform cushioned support to help prevent fatigue from prolonged standing and walking such as in office buildings, as well as to absorb impact sounds between floors of multistory dwellings. In addition, substantial cushioning is important in reducing athletic injuries such as shin splints experienced by basketball players. The stability, planarity, and resilient cushioning of the floor are essential for providing an economical, and uniformly comfortable wood flooring system which has an excellent appearance.

Wooden floor members are normally installed at a controlled moisture content of approximately 7% to 8%. After installation, and during dry cold winter seasons when room temperature is maintained at approximately 70° F., the moisture content of the wooden floor members may drop to approximately 5% to 6%, and this can cause minor shrinkage of the wooden floor members. However, a drop in moisture content of less than 3% normally causes only minor shrinkage within wooden floor members. Since open cracks of 1/32" or more between wooden floor members are visually objectionable and provide dirt traps which substantially increase maintenance, an upper installation moisture content of 8% is normally adhered to in geographical areas requiring artificial heat during winter months.

During spring, summer, and fall months, humidity and condensation conditions are more aggravated than they are in winter months and normally increase the moisture content of the wooden floor members above the level at which they were installed. This gives rise to expansion forces within the wooden floor members. These forces are directly related to the increased moisture content of the wooden floor members. A moisture content of 8% to 10% in the wooden floor members is not unusual during summer months.

As the moisture content of wooden floor members increases above the moisture content at time of installation, the wooden floor members expand if permitted to do so. If unrestricted lateral expansion is permitted, large undesirable shrinkage cracks may appear between the wooden floor members during the following dry season. If lateral expansion is limited, such as by perimeter walls, or by the gripping and tensile strength of the adhesive, the lateral expansion force translates itself into a vertical lifting force. Buckling is defined as the condition which exists when a wooden floor system separates itself vertically from the supporting base. Depending on the type of adhesive-applied wood flooring system being considered. such buckles can raise several inches above the normal floor surface.

In a resiliently cushioned restricted-growth, adhesive-applied wood flooring system, it is, therefore, necessary for the adhesive to not only restrict the lateral growth of wooden floor members during periods of increased moisture content, but it is necessary to restrict potential vertical displacement of the wooden floor members.

If a wood flooring system is to maintain an essentially monolithic appearance during normal moisture change cycles, it is desirable that it be installed at a moisture content approximately 3 moisture content percentage points higher than the lowest average level which is anticipated during dry winter months; and it is further necessary that the adhesive securing the wooden floor members to the supporting base have sufficient gripping and tensile strength to control normal expansion and buckling forces which exist during damper periods of the year.

Prior flooring systems wherein wood members were adhesively secured to the supporting base do not combine by use of the adhesive alone elastomeric resilient cushioned response with substantial resistance to movement and buckling caused by stresses induced by normal moisture in the wooden flooring members and do not provide an ability to overcome the non-planarity of a supporting base. Most frequently, problems arose as a result of adhesives that could not bridge an uneven supporting base, adhesives which did not hold well, and adhesives which did not provide cushioned resiliency to the floor system. The prior art adhesives, often asphalt emulsions, asphalt cutbacks, epoxies, polyvinyl acetates, or solvent based rubbers, lacked the combination of substantial holding power to both wood and concrete in combination with substantial cushioned resiliency and an ability to overcome uneven base conditions. Additionally, some were difficult to apply and had short working times before they set. None provided a substantial resilient cushioning effect.

Several attempts have been made to solve these problems. Elmendorf in U.S. Pat. No. 2,018,711 uses a non-cushioned, non-bridging adhesive and provides for appreciable expansion between the flooring members. Accordingly, Elmendorf fails to achieve a resiliently cushioned, bridged and restricted-growth wood floor system.

Other adhesive-applied flooring systems use rigid adhesives which may limit the movement of the wood flooring members, but they fail to provide substantial resilient cushioning and bridging capacity in the adhesive.

Other adhesive-applied wood flooring systems are able to achieve resilient cushioning by use of a cushioning non-adhesive layer spaced between the base and the flooring boards, but these systems failed to tightly grip and retain the floor boards in their desired disposition and further fail to accommodate non-planarity of the supporting base.

As a result of the foregoing, consumers wishing an adhesive-applied wood flooring system applied directly to a support base have been required to select either a rigidly restrained non-cushioned adhesive-applied system without bridging capacity or an adhesive-applied cushioned system without positive restraint and without bridging capacity.

Other U.S. patents teach various composite flooring systems including Marino, U.S. Pat. No. 3,365,850; Bartolini, U.S. Pat. No. 3,521,418; and Munro, U.S. Pat. No. 1,250,623. In each of these patents, the floor boards are separated by spaces, the spaces being filled with some type of relatively easily compressible material. The flooring systems of each do not combine, by use of adhesive alone, resilient cushioning and positive restraint of individual board members and bridging.

The novel flooring system described below overcomes these deficiencies and provides a flooring system having uniform planarity, an essentially monolithic surface, cushioned resilience, stability and the ability to accommodate a relatively uneven support base.

As contrasted with prior art low-pressure-between-board systems which are designed to permit board growth and movement, the present invention provides for lateral and vertical restraint of wood floor members during periods of normal increases in moisture content with resultant expansion forces within the floor system. It does this while simultaneously providing resilient cushioning and bridging should the support base be relatively non-planar.

An elastomeric resilient cushioning adhesive, such as a two-component polyurethane with an appropriate viscosity, is provided in spaced ridges between the floor boards and the supporting base such as concrete, plywood or the like.

When the wooden flooring members are placed on the uncured spaced ridges of adhesive and pressed into the adhesive to achieve a controlled spacing from the base, the adhesive achieves contact with the bottom of the wood flooring members and displaces as required as a function of non-planarity in the supporting base. The adhesive, after it is cured, provides a bond of high strength between the flooring members and the supporting base and provides bridging action over minor depressions in the supporting base. The flooring system, as thus described, is termed a resiliently cushioned restricted growth adhesive applied bridged flooring system because the system provides excellent cushioning while restricting lateral or upward buckling movement of the floor boards during periods of moisture-induced stress while simultaneously overcoming non-planarity in the base.

In the preferred embodiment, I use an uncured elastomer of urethane which is sufficiently thickened so that it can be troweled or applied by use of a caulking gun onto the supporting base in a desired adhesive ridge configuration. The increased initial viscosity of the uncured elastomer is achieved by the addition of approximately two parts by volume of powdered filler such as fumed colloidal silicon dioxide to one part of liquid elastomer. If a thicker consistency is desired, additional powdered filler can be added.

A suitable two-component urethane is sold by Powerlock Systems, Inc. under the trademark "Versaturf 360".

By troweling the material in spaced ridges, the usage of the material is maintained at a minimum, thereby controlling the adhesive cost of the flooring system. Further, the troweled material exerts an initial grabbing force on the wooden floor members set into the trowelable material. In contrast to using a low viscosity liquid urethane which spreads and initially fills the lowest areas in the base, the trowelable material maintains a substantially uniform troweled ridge height over the base, even if the base is uneven. In addition, less labor is required to effect troweling, and troweling permits completion of isolated sections of the floor at a rate which can be set by the worker.

A troweling tool is preferably provided with an edge serration pattern which provides a ridged pattern for the adhesive material on the supporting base. The ridges are spaced from each other. In the preferred embodiment, the ridges are approximately one-quarter inch wide, are approximately three-sixteenths inch high, and are spaced from one another by approximately one-half inch.

Beads with appropriately low resistance to crushing such as styrene or cured elastomer beads of material having a predetermined uniform diameter of approximately three-thirty-seconds inch may be spread in isolated fashion over or preferably between the ridges of the uncured adhesive to control the minimum spacing of the wooden floor members from the supporting base.

The initial support beads, having three-thirty-seconds inch diameter, permit vertical displacement of the adhesive ridges by a maximum amount of three-thirty-seconds of an inch to overcome minor localized non-planarity of the base. The initial support beads, while having adequate resistance to compression to resist initial application forces applied to embed the flooring members in the ridges, do not have adquate resistant to compression to materially affect the resilient cushioning of the wooden flooring system once the adhesive is cured and normal in-use weights are applied to the wood flooring system. In this manner, uneven crushing of the ridges may occur as a function of the minor non-planarity of the support base. The cured adhesive then provides essentially uniform support to the planar wood flooring members by bridging depressions in the base. Thus, the ridges of uncured adhesive may be unequally crushed as a function of minor depressions in the base.

The foregoing dimensions, including size and spacing of the ridges, can be modified depending upon the degree of resilient cushioning required for the floor, the size of the floor, the moisture variations anticipated, and depending upon the degree of non-planarity of the supporting base.

The durometer of the resilient cushioning adhesive can be varied between approximately 40–60 using a Shore A-2 hardness scale as a guide to secure the desired degree of cushioning, depending on the specific usage intended.

The foregoing disclosed embodiments are preferred since the floor obtained thereby has excellent properties and involves a minimum of cost from a labor and material standpoint.

Various powdered fillers such as fumed colloidal silicon dioxide, sold under the trademark "CAB-O-SIL" by Cabot Laboratories can be used for thickening the liquid urethane elastomer. Alternatively, a chemical thickener such as diethylene triamine may be utilized. As the thickened urethane elastomer chemically cures, there is essentially no loss of volume. Thus, important cushioned bridging support is provided between floor boards and any minor depressed portions of the supporting base.

Sections of the floor, during installation, may have embedding forces applied thereto, such as by weight applied to a flat sheet of appropriate thickness which overlies a substantial number of wood flooring members thus insuring both essential planarity of the final floor and insuring intimate contact of the floor boards and the adhesive. Upon application of the flat sheet, the initial support material will aid in maintaining the desired minimum gap between the bottom of the floor boards and the base. A concrete primer, such as silane, may be used to improve the grip between the urethane elastomer and concrete supporting base.

Further, expense of the flooring system is minimized by the ability of the system to utilize relatively thin and short lengths of wood. The boards may be set in any desired pattern, including a parquet configuration. If parquet pattern flooring is used, it is preferred that the ridges be applied in a diagonal pattern to provide desired support for the parquet pattern flooring. The width of the wood boards may be as desired, and the least expensive widths can be used in the present invention. Also, laminated plywood oak blocks, such as nine inch squares by one-half inch thick, unfinished or prefinished with a tongue and groove, can be used in the present invention.

The flooring members may be any conventional type board, tile, block, plywood or Masonite sheets or the like. The flooring members may be made of compressed wood, Masonite, wood chipboard, plywood, oak or maple and may, in fact, comprise the least expensive flooring members available.

Spacing of the adhesive ridges may be appropriately wider when the laminated plywood oak blocks are used because of their inherent stiffness, broad area encompassed by each block, and the basic stability of plywood.

When the adhesive ridges have been applied to the base and increased resistance to vertical buckling is desired, the wood members may have a thin coat of elastomeric urethane of the same type applied thereto. The thickness of the urethane coat may be approximately several mils. The urethane coat will substantially increase the bond between the wooden members and the adhesive ridges if only slight embedment pressure is applied to seat the wooden members.

In a preferred embodiment, the floor boards are approximately five and one-half inches long, five-sixteenths inch thick, and approximately fifteen-sixteenths inch wide and are applied in the same direction transverse to the ridges of adhesive.

For the purpose of illustrating the invention, there is shown in the drawings a form which is presently preferred; it being understood, however, that this invention is not limited to the precise arrangements and instrumentalities shown.

FIG. 1 is a partial perspective view of a flooring system constructed in accordance with the present invention;

FIG. 2 is a section view taken along lines 2—2 of FIG. 1 before the adhesive ridges have been compressed; and FIG. 3 is a partial perspective view showing the preferred configuration of adhesive applied to the base or subfloor.

Referring now to the drawings in detail, there is shown in FIGS. 1 through 3 a floor system generally indicated by the reference numeral 10. The system is applied over a subfloor or supporting base 12 which may be concrete, wood or the like.

Troweled ridges of a urethane elastomer 14 are applied to the base 12. When applied to the base, the troweled ridges preferably have a width of approximately one-quarter inch, and a height of approximately three-sixteenth inch. There are gaps of approximately one-half inch between adjacent ridges. As an alternative, the ridges 14 could be applied to the floor boards 20.

Located in the gaps between the ridges 14 and/or on the ridges are a plurality of isolated initial support beads 16. The beads 16 may be made of material such as cured elastomeric urethane or may be of styrene or any other material which has appropriate initial support and in-use yielding properties and has a predetermined essentially uniform diameter less than the ridge height of the adhesive. The purpose of the beads 16 is to control the maximum penetration of the wooden floor members into the uncured adhesive.

Usage of the beads 16 can be eliminated if substantial care is exercised in embedding the wooden floor members into the adhesive to achieve the desired separation between floor members and the base.

The urethane elastomer, after mixing of the two components, and while still in its uncured state, is brought to a trowelable consistency preferably by the addition of approximately two parts by volume of powdered silicon dioxide thereto, so that the elastomer is changed from a flowable liquid to a trowelable mastic consistency.

After the ridges of material 14 are applied, the floor boards, generally indicated by the reference number 18, are pressed into the uncured adhesive 14. The ridges are compressed by pressure applied to the upper face of the boards. The pressure may be applied by the application of weight to a planar sheet overlying a plurality of the boards to correctly seat the boards in the ridges of the uncured adhesive 14.

Beads 16 may be used to limit the crushing of the ridges 14 of uncured adhesive material. As the adhesive material 14 cures, it provides an adhesive and cohesive resilient cushioning elastomeric bond between the floor boards 20 and the base 12. After the adhesive cures, gaps exist between adjacent ridges 14 of the adhesive. The cured adhesive elastomeric ridges 14 in combination with the gaps between ridges provide the resilient cushioning for the floor system 10. The resilient cushioning of the floor system 10 is even greater than would be obtained without providing gaps between the ridges 14.

The material 14, when cured, has high gripping and tensile strength. Lateral or vertical buckling movements, or other distortions of the floor boards as a result of normal atmospheric moisture changes are substantially eliminated. Bridging of minor depressions in the support base is also accommodated.

The installation of various types of flooring boards 20 is illustrated in FIG. 1. The floor boards may be in the shape of rectangular tiles 22 or may be installed in a parquet pattern. Wood flooring tiles of other shapes may also be used, such as Masonite, plywood, etc. The boards 20 may be placed in a tight abutting relationship and pressed into the material 14 in order to create a tightly jointed resiliently cushioned adhesive-applied bridged wood flooring system. When the wooden flooring members are installed in a parquet pattern, the adhesive ridges should be approximately at a 45° angle to the longitudinal axis of the boards.

The material 14 may be a two-component cellular or noncellular filled urethane elastomer. An acceptable material is Versaturf "360" marketed by Powerlock Systems, Inc.

If the upper surface of the floor is sanded, any minor nonplanarity of the wooden floor members can be substantially eliminated.

While the foregoing floor application method is preferred, it is also possible to trowel ridges 14 onto the base 12 or the floor boards 18 and permit the ridges 14 to cure prior to application of the wooden floor members 18 to the base 12. Thereafter, a substantial coating of thickened elastomeric urethane can be applied either to the cured ridges 14, the floor boards 18 if the ridges have been applied to the base or the base 12 if the ridges have been applied to the boards 18. Thereafter, prior to the curing of the roll coat, the wooden floor boards should be seated to insure contact between the ridges and the roll coat. The thickness of the roll coat required is a function of the planarity of the base and the floor boards.

The present invention may be embodied in other specific forms without departing from the spirit or essential attributes thereof and, accordingly, reference should be made to the appended claims, rather than to the foregoing specification as indicating the scope of the invention.

I claim:

1. A restricted-growth resiliently cushioned bridging adhesive-applied wood flooring system comprising a support base and wooden flooring members, uncured elastomeric adhesive spread upon at least one of said support base and said wooden flooring members in spaced ridges, adjacent ridges each having substantially uniform height, at least some of said ridges being spaced a substantial distance from an adjacent ridge, said wooden flooring members being forced toward said base so that an intimate bond of said adhesive ridges with both the base and the bottom faces of the wooden flooring members will be achieved and such that gaps remain between at least some adjacent ridges of adhesive; discrete supporting means between said ridges, said supporting means comprising a plurality of essentially spherical beads made of a material which has a relatively low resistance to crushing but which has sufficient resistance to crushing to provide initial support for said wooden flooring members when said wooden flooring members are initially forced toward said base, said supporting means having a vertical height less than the height of said uncured ridges of adhesive prior to said wooden flooring members being forced toward said base, said adhesive ridges having sufficient gripping and tensile strength to overcome potential buckling forces generated within said wooden members as a result of normal atmospheric moisture changes, and said adhesive, after it has cured, cooperating with the gaps between adjacent ridges of cured adhesive to provide resilient cushioning for said flooring system.

2. A flooring system as defined in claim 1 wherein said elastomeric adhesive comprises a two-component polyurethane, said beads are made of cured elastomeric material, and at least some of said beads being on said uncured adhesive ridges.

3. A flooring system as defined in claim 1 wherein said elastomeric adhesive comprises a two-component polyurethane, said beads are made of styrene, and at least some of said beads being on said uncured adhesive ridges.

4. A flooring system as defined in claim 2 wherein said polyurethane has a Shore A-2 hardness of approximately between 40 and 60.

5. A flooring system as defined in claim 1 wherein said discrete supporting means comprises beads of material, said ridges being approximately one-quarter inch wide, approximately three-sixteenths inch high and being spaced from one another by approximately one-half inch with the diameter of the initial support beads being approximately one-tenth inch.

6. A method of making a restricted-growth resiliently cushioned adhesively-applied bridging flooring system over a supporting base comprising the steps of providing a base and wooden flooring members, thickening an elastomeric adhesive to a trowelable consistency, troweling the adhesive in spaced ridges on at least one of the base and the wooden flooring members, providing initial supporting means between and in the ridges of adhesive with the supporting means having a height less than the height of the uncured ridges, the supporting means having a relatively low resistance to crushing but having sufficient resistance to crushing to provide initial support for the wooden flooring members when the wooden flooring members are pressed toward the base, pressing the wooden flooring members toward the base so that the adhesive ridges contact both the bottom faces of the wooden flooring members and the base while providing gaps between at least some adjacent ridges of adhesive, and allowing the adhesive to cure to a state wherein it has sufficient gripping and tensile strength to overcome potential buckling forces generated within the wooden members as a result of normal atmospheric moisture changes and so that the cured adhesive and the gaps between the cured adhesive cooperate to provide resilient cushioning for the flooring system.

7. A method of making a flooring system as defined in claim 6 wherein the step of providing initial supporting means includes providing a plurality of essentially spherical beads made of cured elastomeric material, the beads having a diameter less than the height of the ridges when the ridges are in an uncured state.

8. A method of making a restricted-growth resiliently cushioned adhesively-applied bridging flooring system over a supporting base comprising the steps of providing a base and wood flooring members, applying an elastomeric adhesive in spaced ridges to at least one of the base and the wood flooring members, permitting the adhesive ridges to cure, applying an additional layer of uncured elastomeric adhesive to at least one of the cured ridges and the one of the base and wooden flooring members that does not have cured ridges adhered thereto, pressing the wooden flooring members toward the base so that the cured adhesive ridges contact the uncured elastomeric layer thereby providing an intimate bond between the bottom faces of the wood flooring members and the base while providing gaps between at least some adjacent ridges of adhesive, allowing the uncured adhesive layer to cure to a state wherein it cooperates with the cured ridges to provide sufficient gripping and tensile strength to overcome potential buckling forces generated within the wooden members as a result of normal atmospheric moisture changes and so that the adhesive and the gaps between the adhesive cooperate to provide resilient cushioning for the flooring system.

9. A restricted-growth resiliently cushioned bridging adhesive-applied wood flooring system comprising a support base and a plurality of wooden flooring members, each of said flooring members being substantially smaller than said support base, uncured elastomeric adhesive spread upon at least one of said support base and said wooden flooring members in spaced ridges, said adhesive including fumed colloidal silicon dioxide in a two-to-one volume ratio to said adhesive to thicken said adhesive to trowelable consistency, said adhesive in its cured state having a specific height when not under load, and being deformable with desired cushioning to a lesser height when under load and returning substantially to said original height when said load is released, adjacent ridges each having substantially uniform height, at least some of said ridges being spaced a substantial distance from an adjacent ridge, said wooden flooring members being placed in abutting relationship with each other and being forced toward said base so that an intimate bond of said adhesive ridges with both the base and the bottom faces of the wood flooring members will be achieved and such that gaps remain between at least some adjacent ridges of adhesive, said adhesive ridges having sufficient gripping and tensile strength to overcome potential buckling forces generated within said wooden members as a result of normal atmospheric moisture changes, and said adhesive, after it has cured cooperating with the gaps between adjacent ridges of cured adhesive to provide resilient cushioning for said flooring system.

* * * * *